US012680284B2

(12) United States Patent
Brandli

(10) Patent No.: US 12,680,284 B2
(45) Date of Patent: Jul. 14, 2026

(54) ROTATIONALLY MOLDED LIGATURE RESISTANT LAVATORY BASIN

(71) Applicant: Willoughby Industries Inc, Indianapolis, IN (US)

(72) Inventor: Timothy Brandli, Zionsville, IN (US)

(73) Assignee: Willoughby Industries Inc, Indianapolis, IN (US)

( * ) Notice: Subject to any disclaimer, the term of this patent is extended or adjusted under 35 U.S.C. 154(b) by 225 days.

(21) Appl. No.: 18/591,707

(22) Filed: Feb. 29, 2024

(65) Prior Publication Data

US 2024/0295110 A1 Sep. 5, 2024

Related U.S. Application Data

(60) Provisional application No. 63/487,741, filed on Mar. 1, 2023.

(51) Int. Cl.
*E03C 1/18* (2006.01)
*A47K 1/04* (2006.01)

(52) U.S. Cl.
CPC . *E03C 1/18* (2013.01); *A47K 1/04* (2013.01)

(58) Field of Classification Search
CPC ..... A47K 1/04
See application file for complete search history.

(56) References Cited

U.S. PATENT DOCUMENTS 4,336,619 A * 6/1982 Hinkel ..... E03C 1/14 4/619
5,271,105 A 12/1993 Tyler
5,832,546 A 11/1998 Inch
6,112,935 A 9/2000 Shackelford
7,975,325 B2 7/2011 Holmstadt
8,091,157 B2 1/2012 Tyler et al.
8,448,269 B2 5/2013 Libit et al.
9,009,882 B2 * 4/2015 Bucher ..... A47K 1/04 4/619
10,030,377 B1 7/2018 Boeltl
D840,523 S * 2/2019 Boeltl ..... D23/308
(Continued)

FOREIGN PATENT DOCUMENTS

BR PI1104651 A2 8/2013
BR 102012021759 A2 * 6/2015 ..... B29C 51/22
(Continued)

OTHER PUBLICATIONS

Machine translation of BR102012021759 (Year: 2025).*
(Continued)

*Primary Examiner* — Erin Deery
(74) *Attorney, Agent, or Firm* — Woodard, Emhardt, Henry, Reeves & Wagner, LLP

(57) ABSTRACT

A ligature resistant lavatory basin may be produced from rotational molding to create a seamless, one-piece component. The lavatory basin includes a frame that surrounds a bowl that is recessed in the frame. A shroud extends from a bottom surface of the frame. A rear surface opening is defined through a rear surface of the lavatory basin, allowing plumbing components to be fit within an interior space defined within the lavatory basin. The lavatory basin may have rounded corners and edges to reduce the possibility of harm and to reduce the number of possible ligature points on the lavatory basin.

17 Claims, 9 Drawing Sheets

(56) References Cited

U.S. PATENT DOCUMENTS

| | | | | |
|---|---|---|---|---|
| 10,287,759 | B2 * | 5/2019 | Macey | E03C 1/14 |
| D864,362 | S * | 10/2019 | Brandli | D23/284 |
| 10,808,385 | B2 * | 10/2020 | Hamann | E03C 1/0401 |
| D956,187 | S * | 6/2022 | Brandli | D23/284 |
| 11,591,786 | B2 | 2/2023 | Helmstetter et al. | |
| 2015/0052676 | A1 * | 2/2015 | Azmi | A61H 33/6021 4/622 |
| 2020/0037774 | A1 | 2/2020 | Moon et al. | |
| 2022/0112891 | A1 | 4/2022 | Coffey et al. | |

FOREIGN PATENT DOCUMENTS

| | | | | |
|---|---|---|---|---|
| CA | 2960809 | A1 | 9/2017 | |
| CN | 105145392 | A | 12/2015 | |
| DE | 29922895 | U1 * | 2/2000 | E03C 1/18 |
| GB | 2490523 | A | 11/2012 | |
| GB | 2570491 | A * | 7/2019 | E03C 1/322 |
| WO | 2015028059 | A1 | 3/2015 | |
| WO | 2019218150 | A1 | 11/2019 | |

OTHER PUBLICATIONS

PE Mobile Wash Basin [online], [retrieved on Feb. 29, 2024], Retrieved from <https://www.toprotomolding.com/pe-mobile-wash-basin.html>.

Thinktank Waterless Toilets From Composting Toilets USA [online], [retrieved on Feb. 29, 2024], Retrieved from <https://compostingtoiletsusa.com/thinktank-waterless-toilets/>.

* cited by examiner

ROTATIONALLY MOLDED LIGATURE RESISTANT LAVATORY BASIN

BACKGROUND

Ligature resistant products are important features for rooms in healthcare facilities and other environments where there is a danger that an occupant may accidentally injury themselves or try to cause harm to themselves or to others. In particular, surfaces where an occupant may drape or wrap a flexible material, such as clothing, may act as a ligature point and present a risk of ligature to the occupant. In some instances, a lavatory basin may present such a risk to an occupant by presenting ligature points. Therefore, consideration should be given to reducing such a risk. Thus, improvement in this field is desired.

SUMMARY

In certain embodiments, a ligature resistant lavatory basin may be produced using rotational molding. The lavatory basin may include a frame that surrounds a bowl that is recessed within the frame. The bowl may include a drain that allows removal of liquid from the bowl. A shroud may extend from a bottom surface of the frame. The frame may include walls that surround a countertop positioned between the walls of the frame, and the bowl may be defined through the countertop of the frame. Adjacent walls of the frame may be connected to each other by rounded corners that reduce the sharp edges present on the frame.

The bowl of the lavatory basin may include a front bowl wall, a rear bowl wall, a left bowl wall, and a right bowl wall. Adjacent walls of the bowl may be connected to each other by rounded corners that reduce the presence of ligature points in the bowl of the lavatory basin. A drain may be defined through the bowl bottom surface and may allow water or any other liquids that may be introduced into bowl to be removed from the bowl. In some embodiments, the bowl bottom surface may be sloped toward the drain, so that the liquid within the bowl is funneled toward the drain to avoid liquids standing on the bottom surface of the bowl.

The shroud may extend from the bottom surface of the frame and may be integral with the frame. The shroud may include a front shroud wall, a left shroud wall, and a right shroud wall. Adjacent shroud walls are connected by rounded corners that reduce the possibility of ligature points on the shroud. For example, the front shroud wall may be connected to the left shroud wall by a rounded corner and the front shroud wall may be connected to the right shroud wall by a rounded corner.

The lavatory basin may have a rear surface that may include an outer section and an inner section. The outer section and the inner section of the rear surface may be separated by a rear surface ledge that may be contoured so that the inner section is recessed with respect to the outer section. The rear surface ledge may include rounded corners and curved surfaces that assist to prevent ligature points. A rear surface opening may be defined through the rear surface, with the inner section acting as a perimeter surrounding the rear surface recess. The rear surface opening may allow access to a hollow interior of the lavatory basin which provides space for pipes and other plumbing features that may be necessary to operate the lavatory basin. The rear surface opening may be defined through the rear surface at both the frame of the lavatory basin and the shroud of the lavatory basin. Connection openings may be defined through the rear surface of the lavatory basin. The connection openings may be configured to receive connectors that connect the lavatory basin to a support surface, such as a wall.

A method includes forming the lavatory basin using rotational molding. The lavatory basin formed by rotational molding includes a frame including a countertop and a bowl defined within said countertop and a shroud integral to and extending from said frame. In some instances, a connector is inserted through a respective one of one or more connection openings defined through a rear surface of the lavatory basin. The connectors are secured to a support surface to attach said lavatory basin to said support surface. In some examples, the lavatory basin is front-mounted to said support surface. In other examples, the lavatory basin is rear-mounted to said support surface.

Further forms, objects, features, aspects, benefits, advantages, and embodiments of the present invention will become apparent from a detailed description and drawings provided herewith.

DETAILED DESCRIPTION

Figure 1:
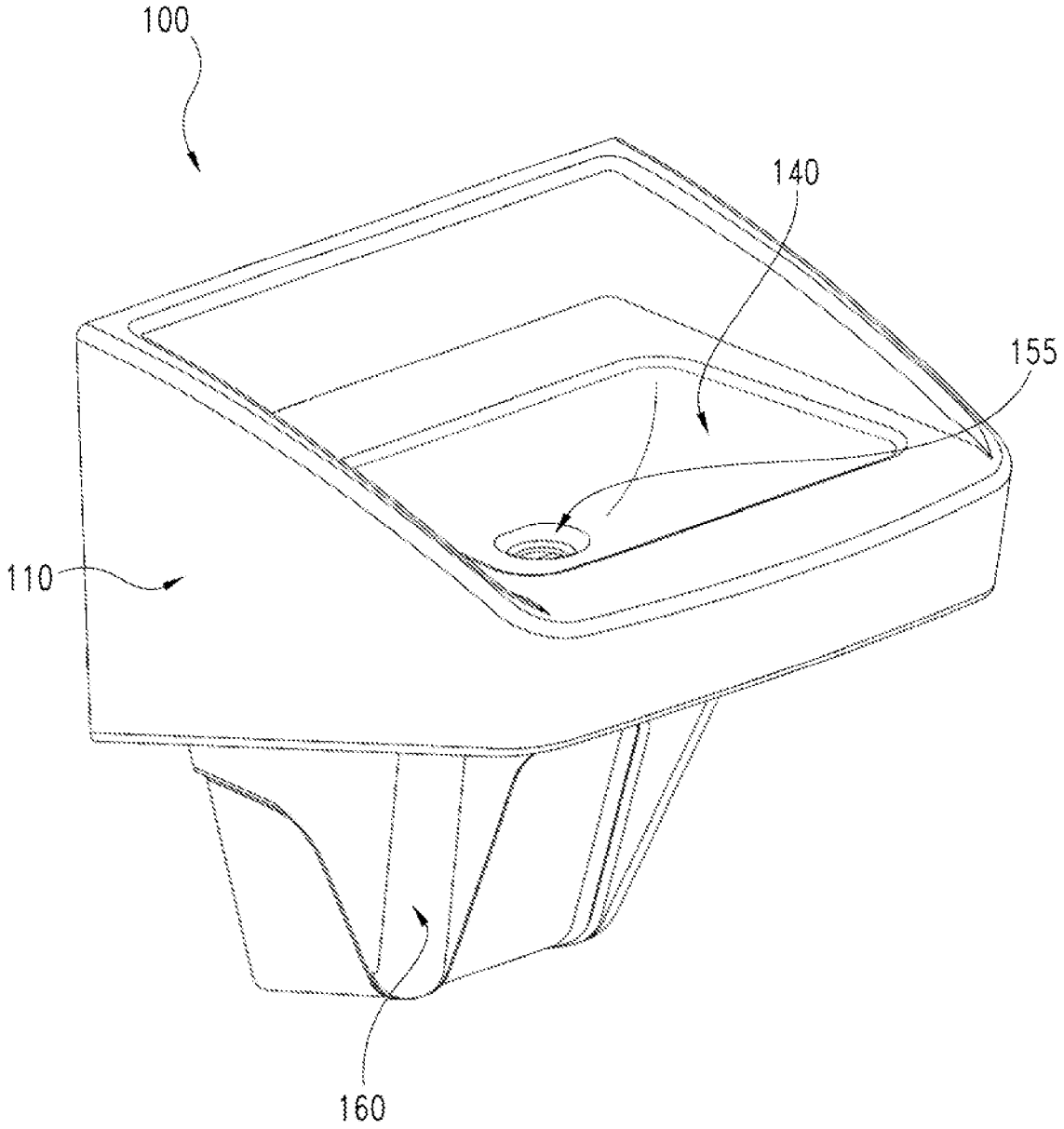
FIG. 1 is a right perspective view of a ligature resistant lavatory basin.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Spatially relative terms such as "lower", "upper", "under", "over", "above" and the like may be used to describe and element's and/or feature's relationship to another element(s) or feature(s), for example as depicted in the Figures. It will be understood that the spatially relative terms are intended to encompass different operations of the system, device or component in use in addition to the orientation described or depicted in the Figures. For example, if a device or component as depicted in the Figures is inverted, an element that is shown and described as "upper" would then be oriented as "lower".

As disclosed above, aspects of the present disclosure relate to a lavatory basin, and in particular a ligature-resistant lavatory basin that may be produced through a rotational molding process.

Figure 2:
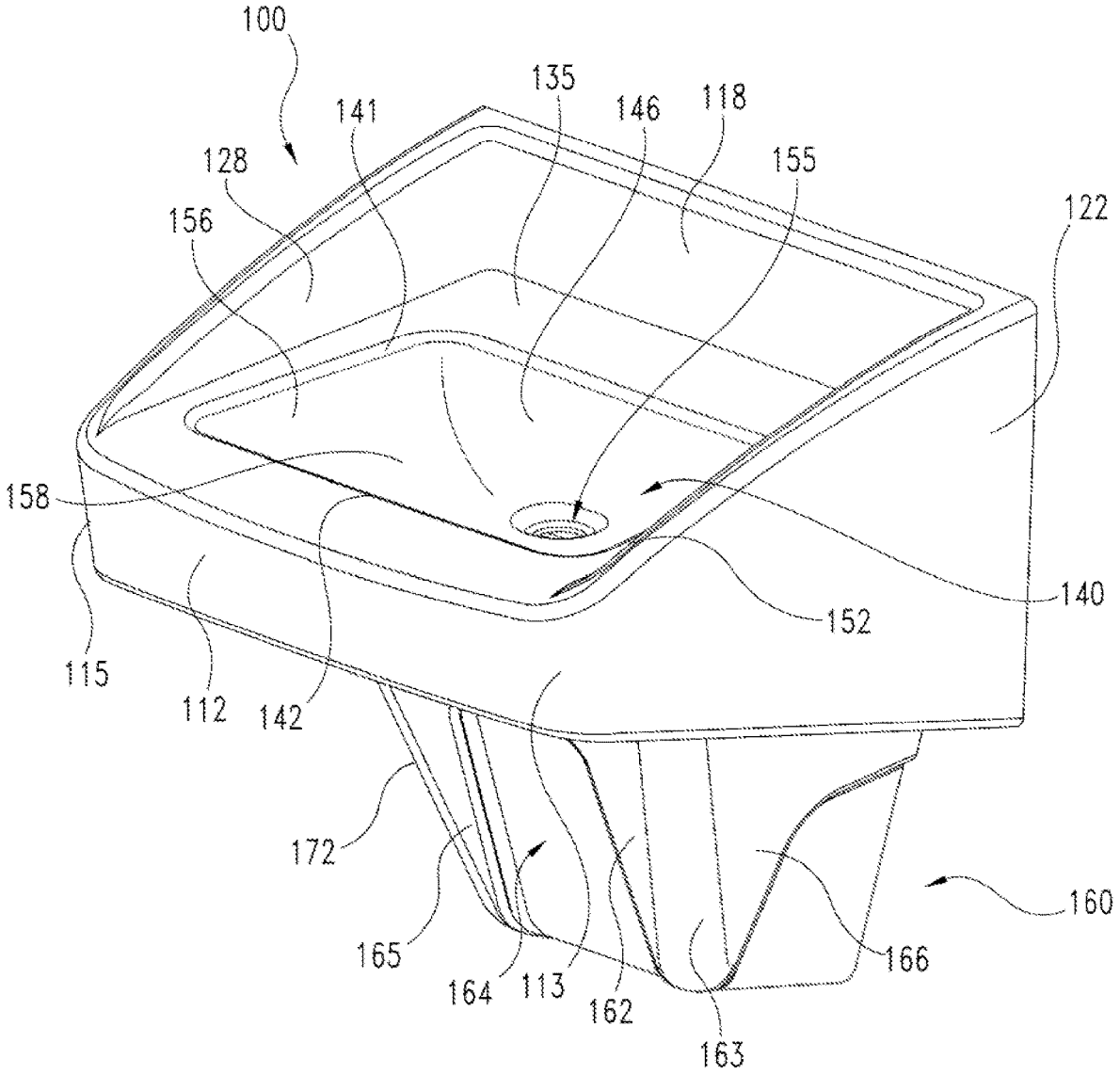
FIG. 2 is a left perspective view of the ligature resistant lavatory basin of FIG. 1.

FIGS. 1-2 illustrate perspective views of a lavatory basin 100. The lavatory basin 100 may be created by rotational molding so that the lavatory basin 100 is monolithic and seamless. As described in further detail below, the corners of the lavatory basin 100 are generally smoothly rounded so that there are no sharp edges on which a person could harm themselves. The reduction of sharp edges and corners also reduces the number of possible ligature points on the lavatory basin 100.

The lavatory basin 100 includes a frame 110 that surrounds a bowl 140 that is recessed within the frame 110. The bowl 140 includes a drain 155 that allows removal of liquid from the bowl 140. A shroud 160 extends from the frame 110. In the embodiment shown, the shroud 160 extends from a frame bottom surface 180 (see FIG. 5).

The frame 110 includes a front wall 112, a rear wall 118, a left wall 122, and a right wall 128. In the embodiment shown, the front wall 112 is generally parallel to the rear wall 118 and the left wall 122 and the right wall 128 each extend between the front wall 112 and the rear wall 118. A countertop 135 is positioned between the walls 112, 118, 122, 128 of the frame 110. The bowl 140 is defined within the countertop 135 of the frame 110.

The front wall 112 of the frame 110 is positioned below the countertop 135, allowing a user access to the countertop 135 and to the bowl 140 of the lavatory basin 100. Each of the rear wall 118, left wall 122, and right wall 128 extend above the countertop 135. A convexly rounded corner 113 forms the connection between the front wall 112 and the left wall 122 of frame 110. Likewise, a convexly rounded corner 115 forms the connection between the front wall 112 and the right wall 128.

As shown in FIG. 2, the bowl 140 is recessed within the countertop 135. A rounded bowl edge is positioned between the bowl 140 and the countertop 135. The bowl includes a front bowl wall 142, a rear bowl wall 146, a left bowl wall 152, and a right bowl wall 156. The front bowl wall 142 is substantially parallel to the rear bowl wall 146, and the left bowl wall 152 is substantially parallel to the right bowl wall 156. Each of the bowl walls 142, 146, 152, 156 is connected to an adjacent bowl wall 142, 146, 152, 156 by a rounded corner. The rounded corners may help to reduce the possibility of ligature points within the bowl 140.

The bowl walls 142, 146, 152, 156 surround a bowl bottom surface 158. The drain 155 is defined through the bowl bottom surface 158 and allows water or any other liquids that may be introduced into bowl 140 to be removed from bowl 140. In some embodiments, the bowl bottom surface 158 may be sloped toward drain 155, so that the liquid within bowl 140 is funneled toward drain 155 to avoid liquids standing on the bottom surface 158 of bowl 140. In the embodiment shown, the drain is circular, but in other embodiments, the drain 155 may be any desired shape.

The shroud 160 extends from the frame bottom surface 180 and is integral with the frame 110. The shroud 160 includes a front shroud wall 162, a left shroud wall 166 and a right shroud wall 172. In some embodiments, the front shroud wall 162 may include a front shroud recessed surface 164. The front shroud wall 162 is connected to the left shroud wall 166 by a left edge rounded corner 163 and the front shroud wall 162 is connected to the right shroud wall 172 by a right edge rounded corner 165. The rounded corners may help to ensure that there are no ligature points on the shroud 160 of the lavatory basin 100.

Figure 9:
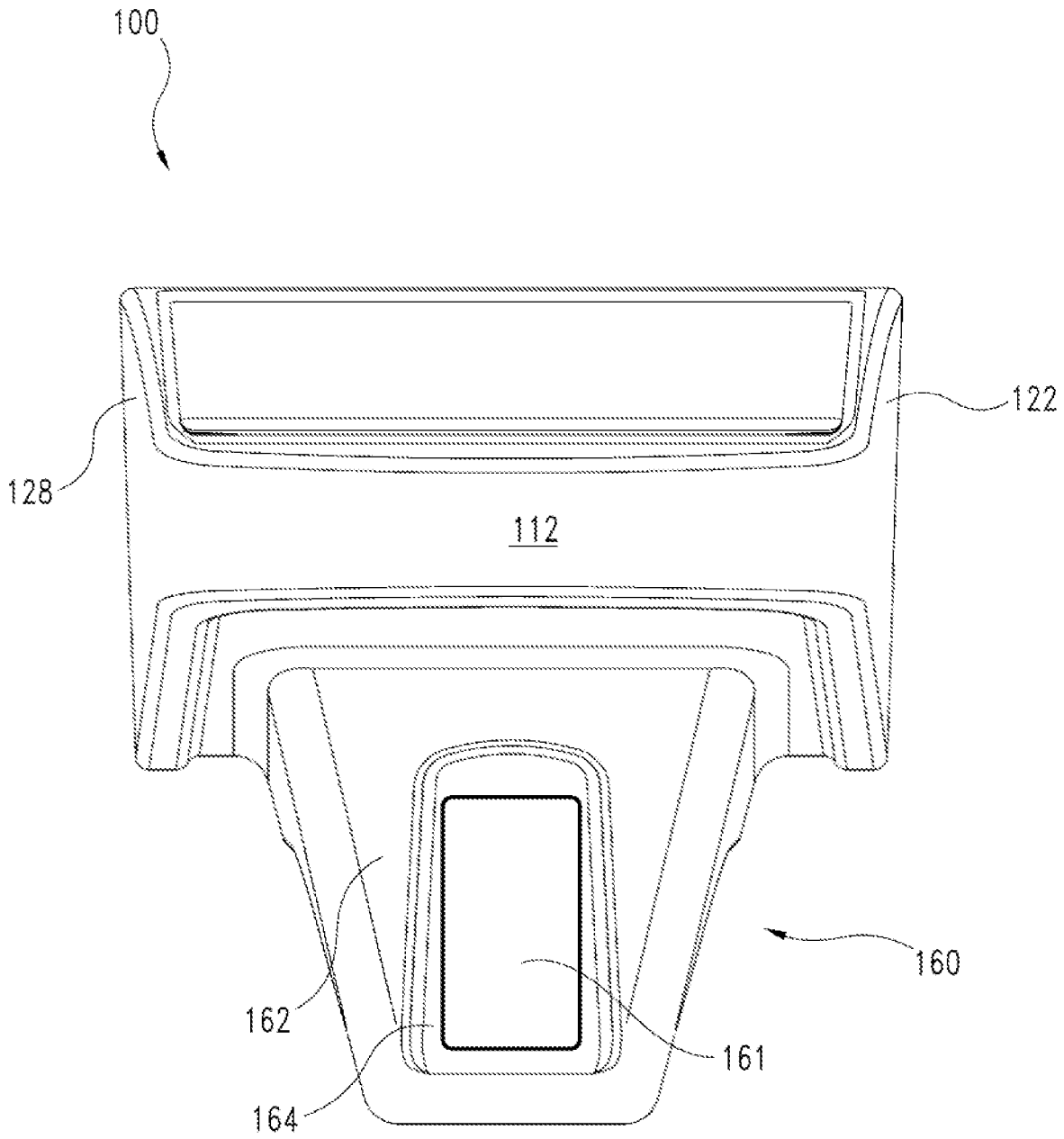
FIG. 9 is a front view of the ligature resistant lavatory basin of FIG. 1 with an access panel.

In some embodiments, the shroud 160 may include an access panel that allows access to a hollow interior 199 of the lavatory basin 100. The plumbing components of the lavatory basin 100 may be housed within the hollow interior 199 of the lavatory basin, so that the access panel allows easy access to these plumbing components when repairs are necessary. In some embodiments, the access panel may be positioned on the front shroud wall 162, for example at the front shroud recessed surface 164 (see FIG. 9). In other examples, the access panel may be positioned on the left shroud wall 166 or on the right shroud wall 172.

Figure 3:
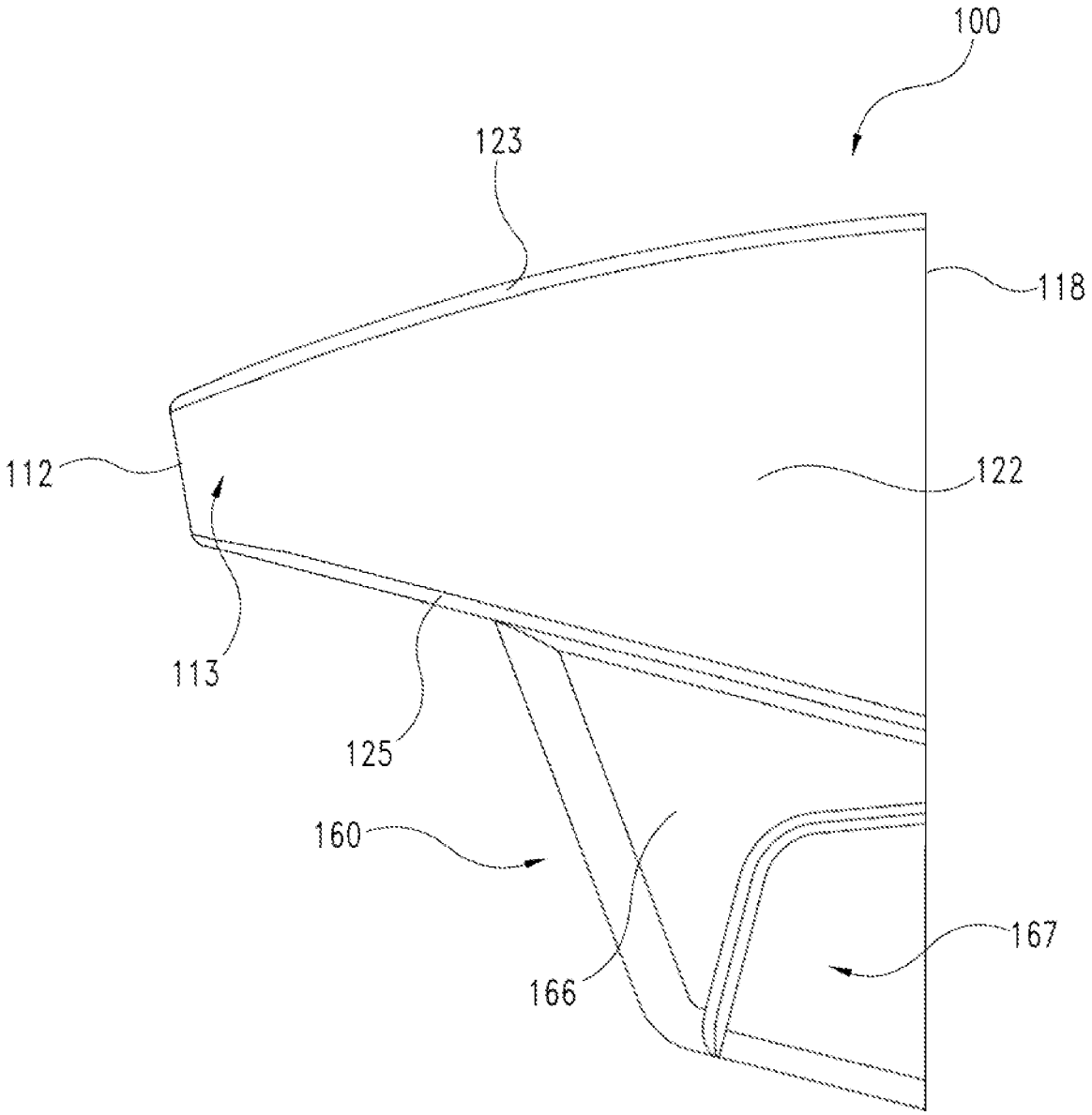
FIG. 3 is a left side view of the ligature resistant lavatory basin of FIG. 1.

A left side view of the lavatory basin 100 is shown in FIG. 3. As shown, the left wall 122 of frame 110 includes a left wall top edge 123 and a left wall bottom edge 125. The left wall top edge 123 is sloped downward starting from the rear wall 118 and extending to the rounded corner 113 at front wall 112. The left wall bottom edge 125 slopes upward from the rear wall 118 to the rounded corner 113 at the front wall 112. Therefore, a width of the left wall 122 increases moving from the front wall 112 to the rear wall 118. The left shroud wall 166 is positioned below the left wall 122 of frame 110. In some embodiments, the left shroud wall 166 may include a left shroud recessed surface 167.

Figure 4:
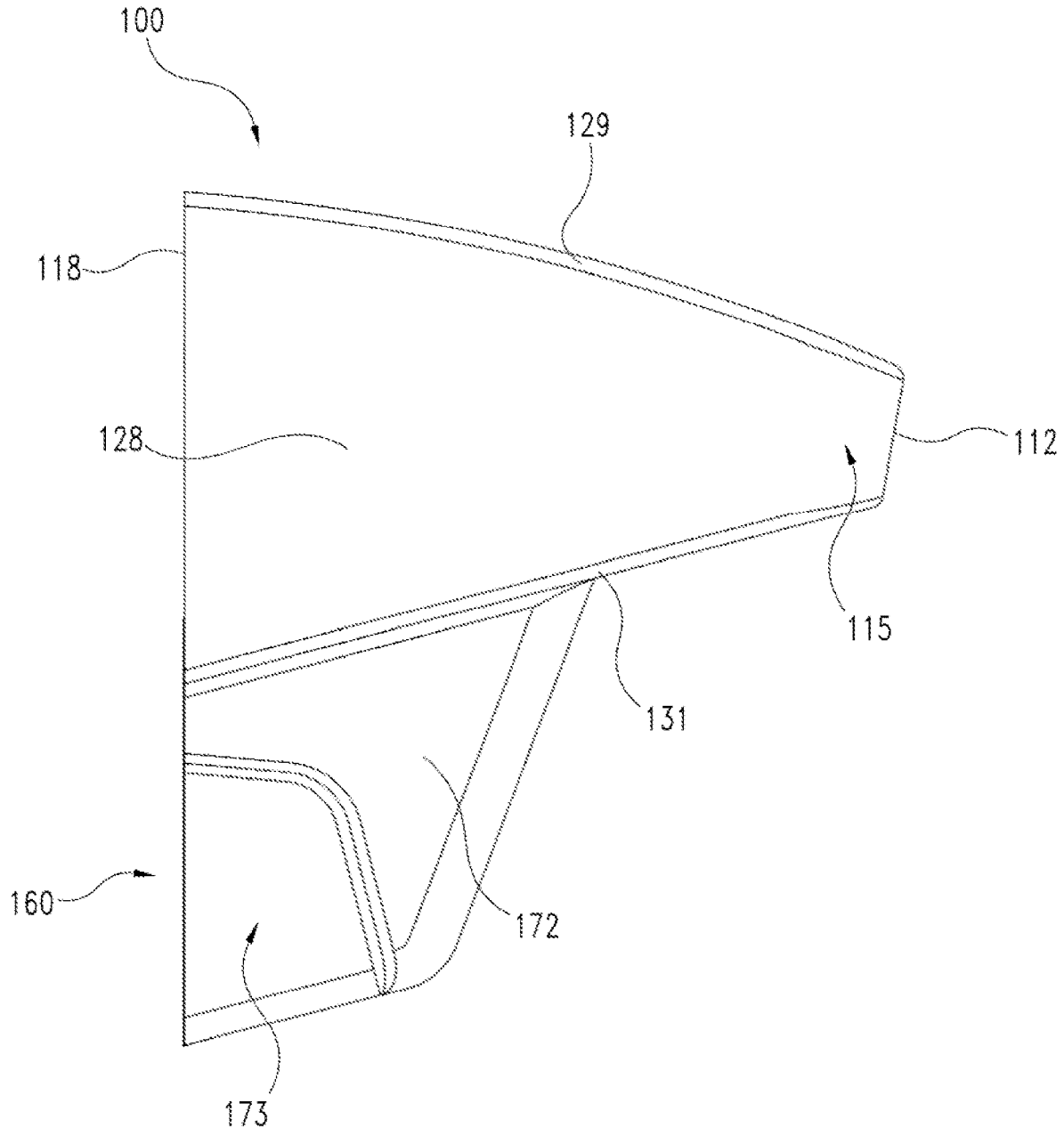
FIG. 4 is a right side view of the ligature resistant lavatory basin of FIG. 1.

A right side view of the lavatory basin 100 is illustrated in FIG. 4. The right wall 128 of frame 110 includes a right wall top edge 129 and a right wall bottom edge 131. The right wall top edge 129 is sloped downward starting from the rear wall 118 and extending to the rounded corner 115 at front wall 112. The right wall bottom edge 131 slopes upward from the rear wall 118 to the rounded corner 115 at the front wall 112. Therefore, a width of the right wall 128 increases moving from the front wall 112 to the rear wall 118. The right shroud wall 172 is positioned below the right wall 128 of frame 110. In some embodiments, the right shroud wall 172 may include a right shroud recessed surface 173.

Figure 5:
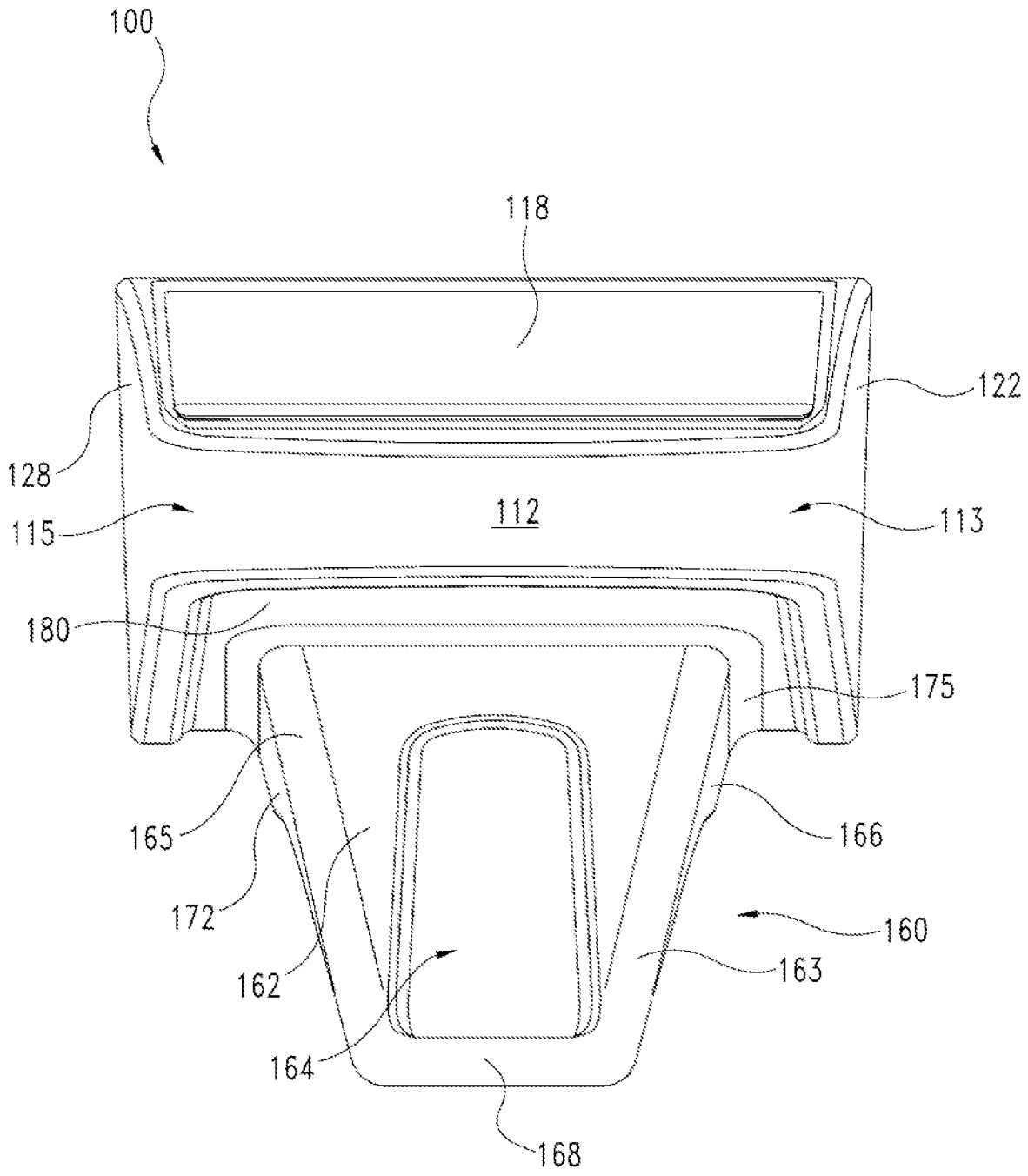
FIG. 5 is a front view of the ligature resistant lavatory basin of FIG. 1.

A front view of the lavatory basin 100 is shown in FIG. 5. The frame bottom surface 180 is shown beneath the front wall 112 and attached to the left wall 122 and the right wall 128. The shroud 160 is integrally connected to the frame 110 at the bottom surface 180. A rounded shroud connection surface 175 connects the shroud 160 to the bottom surface 180 of the frame 110. The curved shape of the rounded shroud connection surface 175 assists to reduce the possibility of ligature points at the connection between the shroud 160 and the frame bottom surface 180. FIG. 5 also shows a shroud bottom surface 168.

Figure 6:
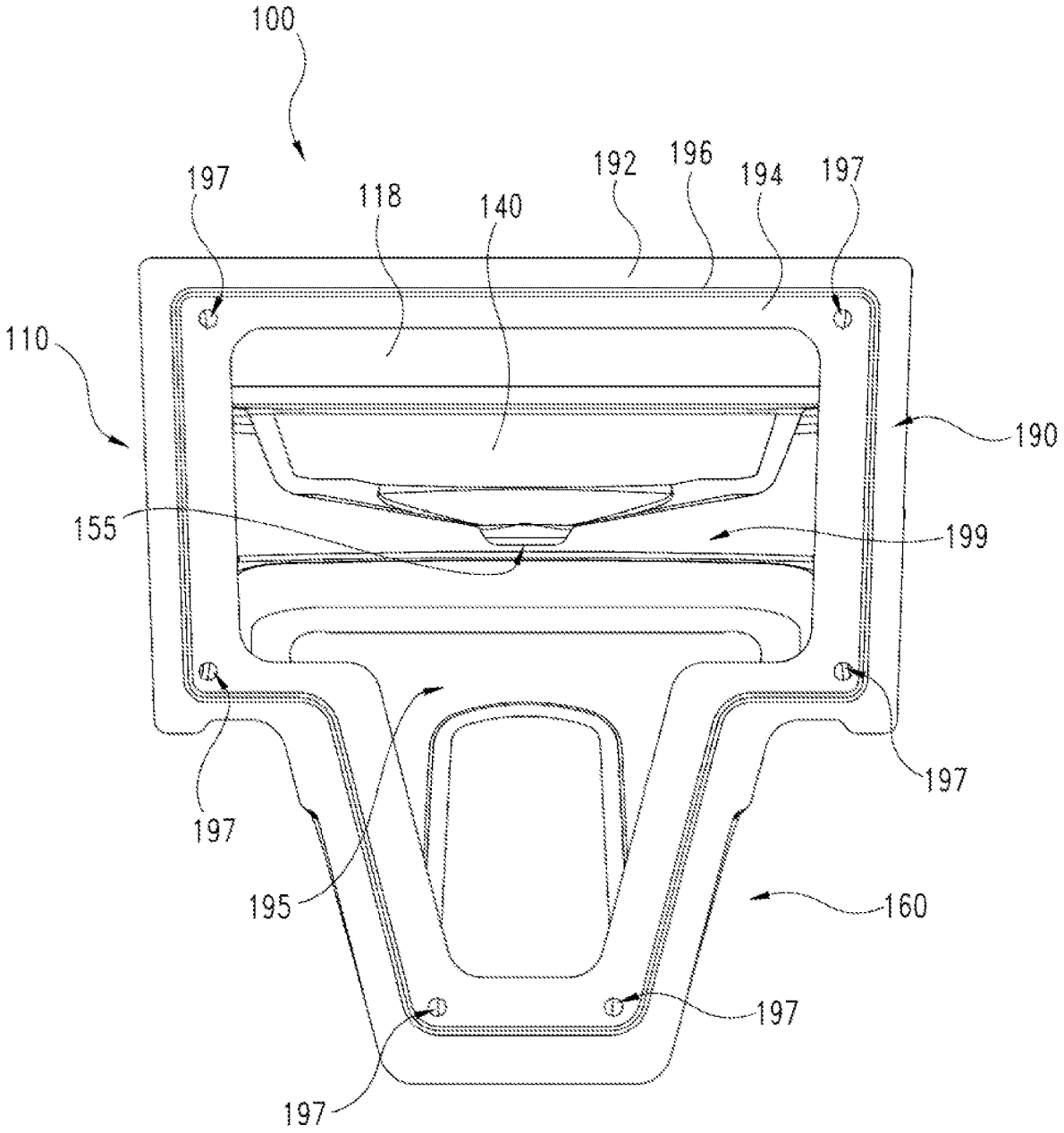
FIG. 6 is a rear view of the ligature resistant lavatory basin of FIG. 1.

FIG. 6 is a rear view of the lavatory basin 100. As shown, the lavatory basin 100 has a rear surface 190 that includes an outer section 192 and an inner section 194. The outer section 192 and the inner section 194 of the rear surface 190 are separated by a rear surface ledge 196 that is contoured so that the inner section 194 is recessed with respect to the outer section 192. The rear surface ledge includes rounded corners and curved surfaces that assist to prevent ligature points. A rear surface opening 195 is defined through the rear surface 190, with the inner section 194 acting as a perimeter surrounding the rear surface opening 195. The rear surface opening 195 allows access to the hollow interior 199 of the lavatory basin 100 which provides space for pipes and other plumbing features that may be necessary to operate the lavatory basin 100. The rear surface opening 195 is defined through the rear surface 190 at both the frame 110 of the lavatory basin 100 and the shroud 160 of the lavatory basin 100.

A number of connection openings 197 are defined through the rear surface 190 of the lavatory basin 100. The connection openings 197 are configured to receive connectors that connect the lavatory basin 100 to a support surface, such as a wall. The connectors may be any suitable component for connecting the lavatory basin 100 to the support surface such as bolts, screws, or any other suitable connector. In some embodiments, the lavatory basin 100 may be front-mounted to the wall. In other embodiments, the lavatory basin 100 may be rear-mounted to the wall.

In the embodiment shown in FIG. 6, the connection openings 197 are defined through the inner section 194 of the rear surface 190. However, in other embodiments, the connection openings 197 may be defined through the outer section 192 of the rear surface 190 or may be defined through both the inner section 194 and the outer section 192 of the rear surface. In the embodiment shown, there are a total of six connection openings 197. However, in other embodiments, more or fewer connection openings 197 may be present, as desired.

Figure 7:
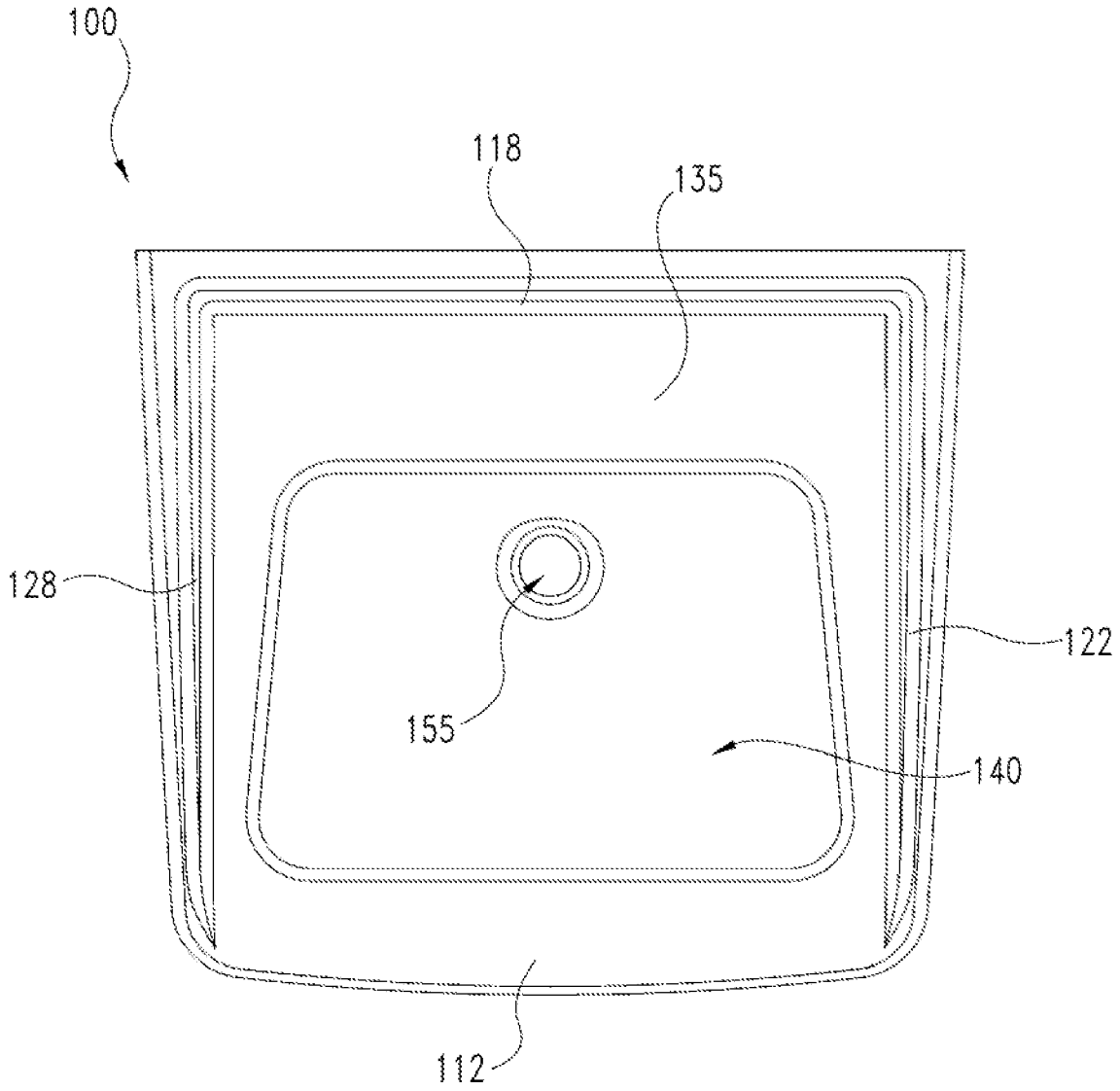
FIG. 7 is a top view of the ligature resistant lavatory basin of FIG. 1.
Figure 8:
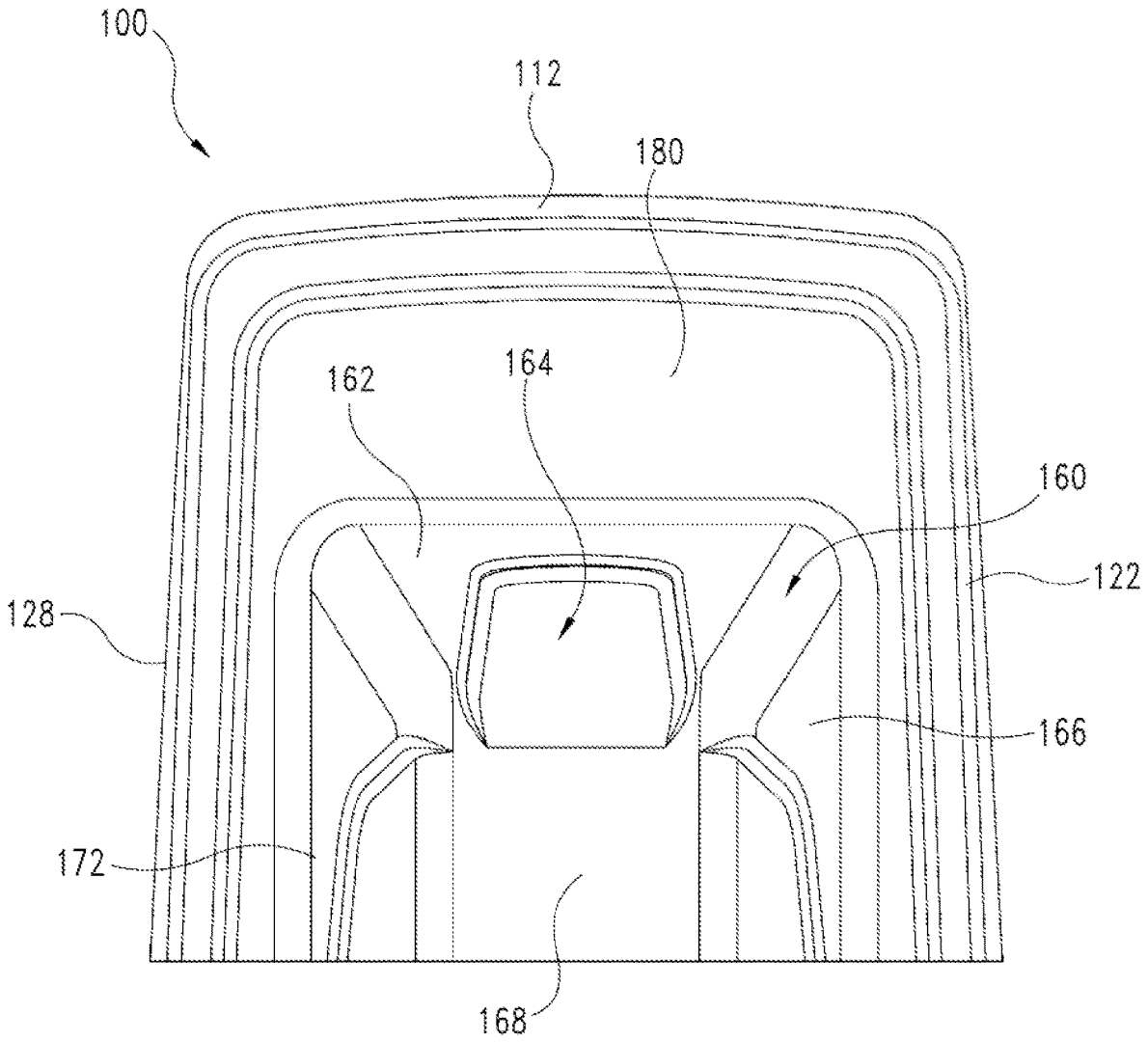
FIG. 8 is a bottom view of the ligature resistant lavatory basin of FIG. 1.

A top view of the lavatory basin 100 is shown in FIG. 7. A bottom view of the lavatory basin 100 is shown in FIG. 8.

The lavatory basin 100 may be manufactured using rotational molding. Rotational molding is a manufacturing process that is suitable for creating hollow, one-piece components. The rotational molding process starts with a product material that is usually in powder form, but may be a liquid in some embodiments. Typically, the product material is some variety of polymer or plastic, but other suitable materials may be used as desired. The product material is inserted into a mold that is formed into the shape of the final product. The mold is closed with the product material inside and the mold is rotated about at least two axes. In some embodiments, the mold may also be rotated at varying speeds.

As the mold is rotated, the mold and the product material within the mold is heated. As the mold is rotated, the heated product material is pushed against the walls of the mold through centrifugal force. After the product material has been adhered to the walls of the mold, the mold is cooled to allow the product material to solidify into a final product in the desired shape of the mold. After cooling, the final product is removed from the mold. In some embodiments, the product material will shrink during the cooling process, allowing easy removal of the final product from the mold.

Rotational molding may be beneficial for manufacturing ligature resistant components because rotational molding may be used to create a seamless product. Therefore, lavatory basin 100 can be produced through rotational molding so that lavatory basin does not have any seams. A seam may produce a ligature point on a product, so the reduction of seams or the complete elimination of seams on lavatory basin 100 reduces the number of potential ligature points.

The uses of the terms "a" and "an" and "the" and similar references herein (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the products or methods defined by the claims.

While embodiments of the disclosure have been illustrated and described in detail in the drawings and foregoing description, the same is to be considered as illustrative and not restrictive in character, it being understood that only some embodiments have been shown and described and that all changes and modifications that come within the spirit of the disclosures herein are desired to be protected.

The invention claimed is:

1. A ligature resistant lavatory basin comprising:

a frame including a countertop and a bowl defined within said countertop;

a shroud extending from said frame, wherein said shroud is integrally formed with said frame;

a rear surface including an outer section and an inner section, and wherein said inner section of said rear surface is recessed with respect to said outer section;

wherein a rear surface ledge separates said outer section of said rear surface from said inner section of rear surface, and wherein said rear surface ledge has rounded corners; and wherein said lavatory basin is formed by rotational molding so that said frame and said shroud are monolithic.

2. The ligature resistant lavatory basin of claim 1, wherein said frame includes a front wall and a rear wall, a left wall extending between said front wall and said rear wall, and a right wall extending between said front wall and said rear wall.

3. The ligature resistant lavatory basin of claim 2, wherein a convexly rounded front right corner is positioned between said front wall and said right wall.

4. The ligature resistant lavatory basin of claim 3, wherein a convexly rounded front left corner is positioned between said front wall and said left wall.

5. The ligature resistant lavatory basin of claim 1, further comprising:

a rounded bowl edge positioned between said bowl and said countertop.

6. The ligature resistant lavatory basin of claim 1, wherein said shroud includes a front shroud wall, a left shroud wall, and a right shroud wall.

7. The ligature resistant lavatory basin of claim 6, wherein said front shroud wall is connected to said left shroud wall at a left edge rounded corner.

8. The ligature resistant lavatory basin of claim 7, wherein said front shroud wall is connected to said right shroud wall at a right edge rounded corner.

9. The ligature resistant lavatory basin of claim 6, wherein said shroud includes an access panel, and wherein said access panel provides access to a hollow interior of said frame.

10. The ligature resistant lavatory basin of claim 9, wherein said access panel is positioned on the front shroud wall of said shroud.

11. The ligature resistant lavatory basin of claim 1, wherein a rounded shroud connection surface connects said shroud to said frame.

12. The ligature resistant lavatory basin of claim 1, wherein said inner section of said rear surface defines a perimeter of a rear surface opening extending through said rear surface, and wherein said rear surface opening allows access to a hollow interior within the lavatory basin.

13. The ligature resistant lavatory basin of claim 1, further comprising:

one or more connection openings defined through said rear surface, wherein said one or more connection openings are configured to each receive a respective connector to secure the lavatory basin to a support surface.

14. The ligature resistant lavatory basin of claim 13, wherein said one or more connection openings are defined through said inner section of said rear surface.

15. A method comprising:

forming a lavatory basin using rotational molding;

wherein said lavatory basin includes a frame including a countertop and a bowl defined within said countertop and a shroud integral to and extending from said frame;

wherein said lavatory basin includes a rear surface including an outer section and an inner section, and wherein said inner section of said rear surface is recessed with respect to said outer section; and wherein a rear surface ledge separates said outer section of said rear surface from said inner section of said rear surface, and wherein said rear surface ledge has rounded corners.

16. The method of claim 15, further comprising:

inserting a connector through a respective one of one or more connection openings defined through the rear surface of said lavatory basin; and securing each of said connectors to a support surface to attach said lavatory basin to said support surface.

17. The method of claim 16, wherein said lavatory basin is rear-mounted to said support surface.

* * * * *